US009970202B2

(12) United States Patent
Kimel

(10) Patent No.: US 9,970,202 B2
(45) Date of Patent: May 15, 2018

(54) MOLDING STRUCTURE

(71) Applicant: Klaus Kimel, Brookline, MA (US)

(72) Inventor: Klaus Kimel, Brookline, MA (US)

( * ) Notice: Subject to any disclaimer, the term of this patent is extended or adjusted under 35 U.S.C. 154(b) by 0 days. days.

(21) Appl. No.: 14/605,385

(22) Filed: Jan. 26, 2015

(65) Prior Publication Data

US 2016/0215508 A1 Jul. 28, 2016

(51) Int. Cl.
*E04F 19/02* (2006.01)
*E04F 19/04* (2006.01)

(52) U.S. Cl.
CPC ..... *E04F 19/0477* (2013.01); *E04F 19/045* (2013.01)

(58) Field of Classification Search
CPC . B61H 9/02; A47K 3/008; E04F 19/04; E04F 19/0436; E04F 19/045; E04F 19/0477; E04F 19/049; E04F 13/073; E04F 13/076; E04F 19/0486; E04F 19/0459
USPC ..... 104/113, 53, 112, 115; 105/26.1, 148, 105/150; 472/45, 120, 123; 52/290, 52/713.2, 288.1, 588.1, 716.1, 716.8, 52/717.02, 717.05, 718.04, 287.1, 309.13, 52/461, 470, 471, 472, 631; 428/119
See application file for complete search history.

(56) References Cited

U.S. PATENT DOCUMENTS 3,161,926 A 12/1964 Schaub
3,222,837 A 12/1965 Daley
4,538,380 A * 9/1985 Colliander ..... E06B 7/2309 49/475.1
4,659,869 A * 4/1987 Busby ..... 174/354
5,157,886 A 10/1992 Azzar et al.
5,199,232 A * 4/1993 Chandler ..... E04B 1/7023 52/169.5

(Continued)

FOREIGN PATENT DOCUMENTS

KR 20070095699 A 10/2007

OTHER PUBLICATIONS

Harrison, Tom, "How an Energy Audit, Some Caulk and Insulation (Total Cost $1175) is Saving Me $1000 . . . Per Year." blog article, http://www.energycircle.com/blog/2010/01/22/how-an-energy-audit-some-caulk-and-insulation-total-cost-1175-is-saving-me-1000-per-year (accessed Apr. 2, 2014).

(Continued)

*Primary Examiner* — William V Gilbert
(74) *Attorney, Agent, or Firm* — Hamilton, Brook, Smith & Reynolds, P.C.

(57) ABSTRACT

A molding structure and associated method includes a baseboard and a seal. The baseboard has a front surface, a back surface opposite the front surface, and a bottom surface extending between the front and back surfaces, the back surface configured to be mounted against a wall, the bottom surface configured to be positioned spaced apart from a floor adjoining the wall. The seal is mounted on the bottom surface of the baseboard and configured so that, when the molding structure is installed at a wall, the seal is compressed between the baseboard and a floor. The baseboard can include a channel along the bottom surface of the baseboard, and the seal can include a flange receivable in the channel to mount the seal to the baseboard. When the molding structure is installed, the baseboard can be separated from the floor and the seal can prevent flow of air between the baseboard and the floor.

23 Claims, 7 Drawing Sheets

(56) References Cited

U.S. PATENT DOCUMENTS

| | | | | |
|---|---|---|---|---|
| 5,367,842 | A * | 11/1994 | Janesky | E04B 1/7023 52/169.5 |
| 5,553,431 | A | 9/1996 | Pelosi, Jr. et al. | |
| 5,887,392 | A * | 3/1999 | Martin | 52/204.5 |
| 6,282,855 | B1 | 9/2001 | Shipton | |
| 6,948,287 | B2 | 9/2005 | Korn | |
| 7,128,585 | B2 | 10/2006 | Evilsizer | |
| 7,574,836 | B2 | 8/2009 | Wesolowska | |
| 8,011,137 | B2 * | 9/2011 | Durfield et al. | 49/489.1 |
| 2003/0024190 | A1 * | 2/2003 | Stanchfield | E04F 15/18 52/287.1 |
| 2004/0040235 | A1 | 3/2004 | Kurtz | |
| 2004/0255539 | A1 * | 12/2004 | Beavers et al. | 52/506.01 |
| 2005/0257485 | A1 | 11/2005 | Hahn | |
| 2007/0175133 | A1 | 8/2007 | Woytowich et al. | |
| 2012/0210667 | A1 | 8/2012 | Daniocek et al. | |

OTHER PUBLICATIONS

Conserve energy with the TPR Door Weatherstrip—AM Conservation Group, Item No. WS051 "TR400 Bulb Weatherproofing" product description, https://www.amconservatorygroup.com/products/WeatherizationProducts/Weatherstrip/TR400BulbWeatherstrip/tr400-bulb-weatherstrip/ (accessed Apr. 2, 2014).

Wood and Vinyl Foam Door Set with Stop, 17" at Aubuchon Hardware product description, http://www.hardwarestore.com/wood-and-vinyl-foam-door-set-with-stop-660501.aspx (accessed Apr. 2, 2014).

* cited by examiner

MOLDING STRUCTURE

BACKGROUND OF THE INVENTION

Molding strips, such as baseboard and crown moldings, are used in buildings to conceal the margins between walls and floors or ceilings. Baseboards are commonly installed using an adhesive or nails. Gaps between the baseboard and the wall can be filled in using caulking.

SUMMARY OF THE INVENTION

A molding structure includes a baseboard and a seal. The baseboard has a front surface, a back surface opposite the front surface, and a bottom surface extending between the front and back surfaces, the back surface configured to be mounted against a wall, the bottom surface configured to be positioned spaced apart from a floor adjoining the wall. The seal is mounted on the bottom surface of the baseboard and configured so that, when the molding structure is installed at a wall, the seal is compressed between the baseboard and a floor.

The baseboard can include a channel along the bottom surface of the baseboard, and the seal can include a flange receivable in the channel to mount the seal to the baseboard. In general, the channel and the flange can have similar, but complementary shapes. The channel and the flange can be shaped so that the flange can be inserted into the channel to mount the seal to the baseboard. For example, the channel and the flange can be T-shaped or the channel and the flange can be J-shaped.

In some embodiments, the flange includes a plurality of ribs extending outwardly from the flange to provide a friction fit that secures the flange in the channel. Further, there can be an acute angle between each rib and a side of the flange. For example, the acute angle is in the range of about 35 degrees to about 55 degrees.

When the baseboard is installed at the wall, the baseboard can be separated from the floor and the seal can prevent the flow of air between the baseboard and the floor.

The seal can be a bulb seal and can be a unitary piece of extruded silicone or polyvinyl chloride (PVC). The bulb seal can include a flexible wall, defining a cavity, and a flat portion in contact with the bottom surface of the baseboard when the bulb seal is mounted to the bottom surface of the baseboard. The bulb seal can further include a flexible projection that extends from the flexible wall and that is capable of contacting the floor when the molding structure is installed. For example, the projection can be curved so that the surface of the projection that is in contact with the floor is closer to the wall than the remainder of the projection.

Another embodiment is directed to a method of installing a molding structure that includes a baseboard and a seal. The method includes placing the molding structure against a wall. The baseboard has a front surface, a back surface opposite the front surface, and a bottom surface extending between the front and back surfaces, the back surface configured to be mounted against the wall, the bottom surface configured to be positioned spaced apart from a floor adjoining the wall. The seal is mounted on the bottom surface of the baseboard and configured so that, when the molding structure is installed at the wall, the seal is compressed between the baseboard and a floor. The method further includes applying pressure to the baseboard to move it toward the floor and compress the seal, and, with the seal compressed, mounting the baseboard to the wall.

A further molding structure includes a board having a front surface and a back surface opposite the front surface, the back surface configured to be mounted against a wall. The board further includes a surface extending between the front and back surfaces and configured to be positioned spaced apart from a floor or ceiling adjoining the wall. The molding structure further includes a seal to be mounted on the surface that extends between the front and back surfaces of the board, the seal configured so that, when the molding system is installed at the wall, the seal is compressed between the board and the floor or ceiling.

The board can include a channel along the surface that extends between the front and back surfaces of the board, the seal including a flange receivable in the channel to mount the seal to the board. When the molding structure is installed at the wall, the board can be separated from the floor or ceiling and the seal can prevent the flow of air between the board and the floor or ceiling. In an embodiment, the board is a baseboard and the seal is mounted on a bottom surface of the baseboard, the seal being compressed between the baseboard and the floor when the molding structure is installed at the wall. In another embodiment, the board is a crown molding and the seal is mounted on a top surface of the crown molding, the seal being compressed between the crown molding and the ceiling when the molding structure is installed at the wall.

Embodiments of the present invention have many advantages. A molding structure that includes a baseboard with a seal, e.g., a bulb seal pre-installed at a bottom surface of the baseboard, as described herein, is energy efficient because the installed molding structure seals and prevents air infiltration at the floor. Advantageously, the bulb seal at the bottom of the baseboard can account for floor imperfections at the room edge and can be adaptable for a variety of floor types. Embodiments of the invention can keep out insects and can be watertight, which can allow the molding structure to be installed in rooms that are subject to high moisture, such as bathrooms or basements. Embodiments can provide an acoustic barrier to prevent unwanted noise. Furthermore, a molding structure with baseboard and seal as described herein is relatively simple and quick to install and is clean, as installation can be accomplished without caulking or other adhesives for sealing. A molding structure that includes a crown molding with a seal, as described herein, has similar advantages.

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

DETAILED DESCRIPTION OF THE INVENTION

A description of example embodiments of the invention follows.

Figure 1:
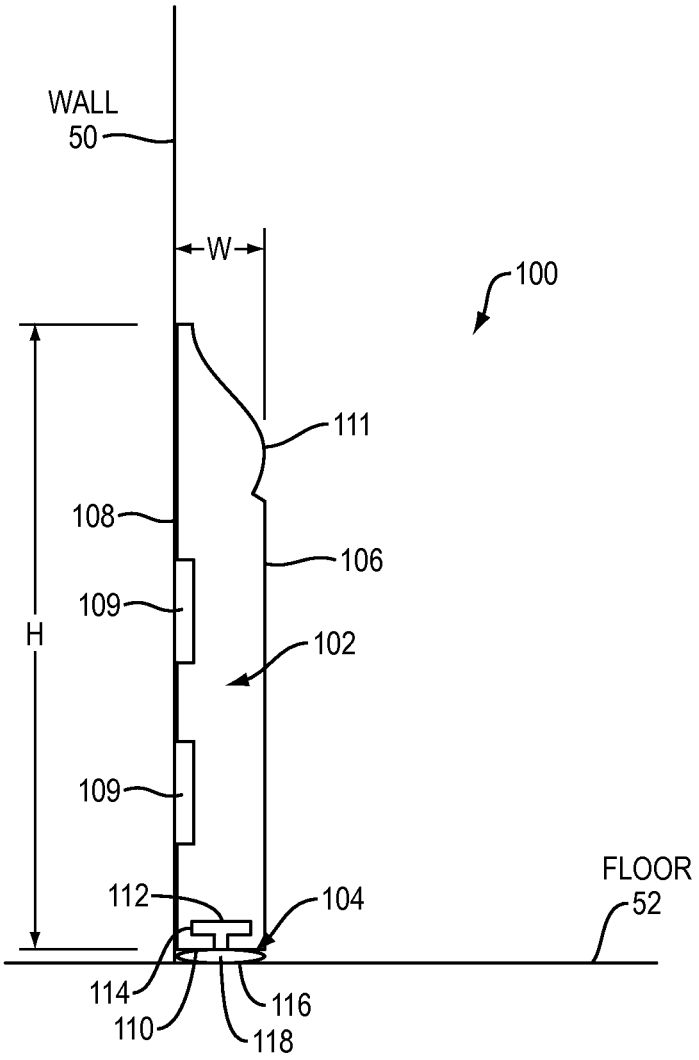
FIG. 1 is a schematic view illustrating an example molding structure installed at a wall and an adjoining floor.

FIG. 1 is a schematic view illustrating a molding structure 100 installed at wall 50 and adjoining floor 52. Wall 50 and floor 52 can be an interior wall and floor of a building. Molding structure 100 includes baseboard 102 and seal 104. The baseboard 102 has a front surface 106, a back surface 108 opposite the front surface, and a bottom surface 110 extending between the front and back surfaces. Optionally, the baseboard can include one or more grooves 109. As shown, the back surface 108, except for grooves 109, is mounted flush against wall 50. The bottom surface 110, which is the lowermost surface of baseboard 102 of FIG. 1, is positioned spaced apart from floor 52, which is adjoining the wall 50. The seal 104 is mounted on the bottom surface 110 of the baseboard 102. When the molding structure 100 is installed at wall 50, as shown in FIG. 1, the seal 104 can be compressed between the baseboard 102 and floor 52. The baseboard 102 is separated from the floor 52 and the seal 104 prevents flow of air between the baseboard 102 and the floor 52. The height H of the baseboard 102 can be any height and can vary dependent upon the application. For example, the height of the baseboard can be in the range of about 1 inch to about 10 inches, or in the range of about 3 inches to about 6 inches. The width W of the baseboard can also vary and be any width and depend upon the application. For example, the width can be in the range of about 0.25 inches to about 1 inch, and can be about 0.5 inches. Preferably, the height of the baseboard is substantially greater than its width, as illustrated in FIG. 1.

As illustrated in FIG. 1, the baseboard 102 includes a channel 112 along the bottom surface 110 of the baseboard. The seal 104 includes a flange 114 receivable in the channel 112 to mount the seal to the baseboard 102. In general, the channel 112 and the flange 114 can have similar, but complementary shapes that are suitable to secure the flange to the baseboard. In the particular example shown in FIG. 1, the channel 112 and the flange 114 appear as T-shape, but other shapes may be used. For example, the channel and the flange can be J-shaped. The channel and flange can be shaped differently from each other in a way that allows the flange to be inserted into the channel.

Baseboard 102 can be manufactured of any suitable material. For example, baseboard 102 can be made from wood, engineered wood, fiber board, laminate, plastic, or any combination thereof. Typically, the baseboard is wooden and the channel 112 can be cut into the baseboard, for example, using a router. Alternatively, the channel 112 may be stamped into the baseboard or, in the case of a baseboard make from MDF or plastic, the channel may be formed using a molding process. The material for the baseboard, or at least the materials for the outer surfaces of the baseboard, may be chosen to match the décor of the room, e.g., matching other woods or surface finishes in the room. As shown in FIG. 1, the baseboard 102 can include an ornamental surface 111, which may be a portion of the front surface 106 near the top of the baseboard, or may be a separate surface that extends between the front and back surfaces 106 and 108.

The seal 104 can be a bulb seal that includes a flexible wall 116 that defines a cavity 118. A portion of the seal 104, e.g., a flat portion (e.g., flat portion 220 in FIG. 2), is in contact with the bottom surface 110 of the baseboard 102 when the bulb seal is mounted to the bottom surface of the baseboard. The bulb seal can further include a projection (e.g., projection 222 in FIGS. 2 and 7). The projection can extend from the flexible wall 116 and contact the floor 52 when the molding structure is installed. The flexible wall 116 of the bulb seal 104 and the projection, if present, can prevent air flow between the baseboard 102 and the floor 52.

The seal 104 can be a unitary piece of extruded silicone or polyvinyl chloride (PVC). An advantage of using silicone or PCV as the material for the seal is that such materials shrink less than other materials, such as rubber, when the seal is exposed to colder temperatures. In addition, silicone and PVC are generally insect proof and water tight, whereas rubber and foam may not be. The seal 104 can be pre-installed on the baseboard 102 at the factory and the molding structure simply cut to size prior to installation. Alternatively, the seal 104 and the baseboard 102 may be delivered separately, e.g., as elements of a molding system, and individually cut to size and then assembled prior to installation.

Molding structure 100 of FIG. 1 can be installed by first placing the molding structure, including baseboard 102 and seal 104, against the wall 50. Next, pressure is applied to the baseboard 102 to move it toward the floor 52 and compress the seal 104. With the seal compressed, the baseboard is mounted to the wall.

Figure 2:
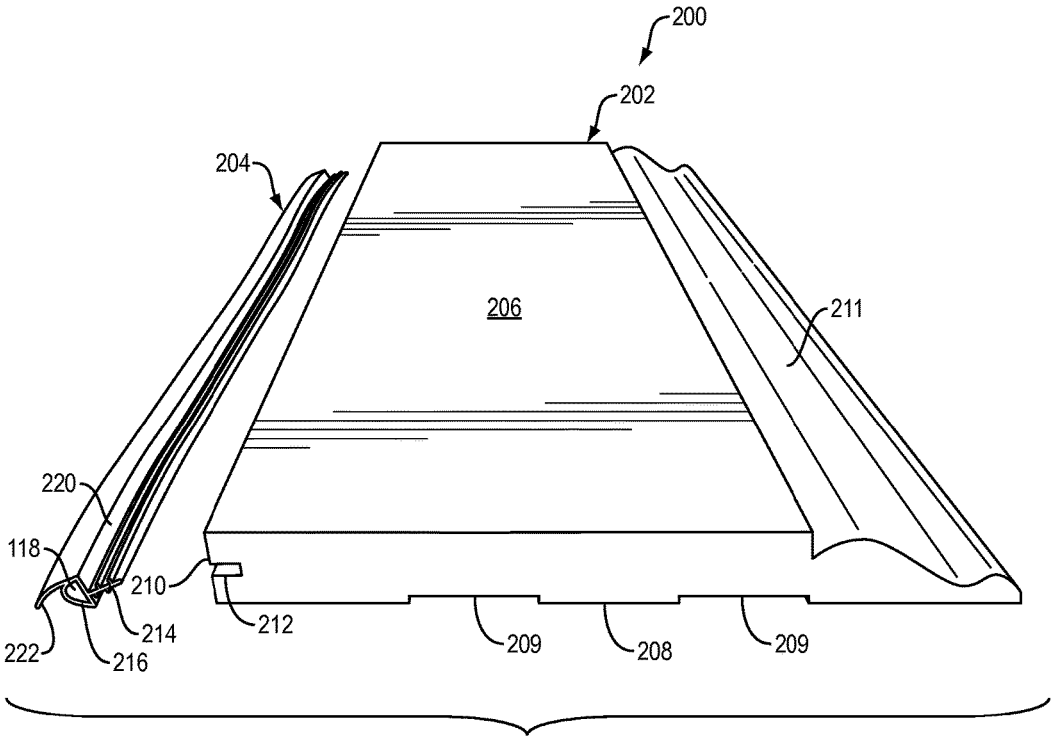
FIG. 2 is a perspective view of a baseboard and a bulb seal of an example molding structure according to an embodiment of the invention.
Figure 3:
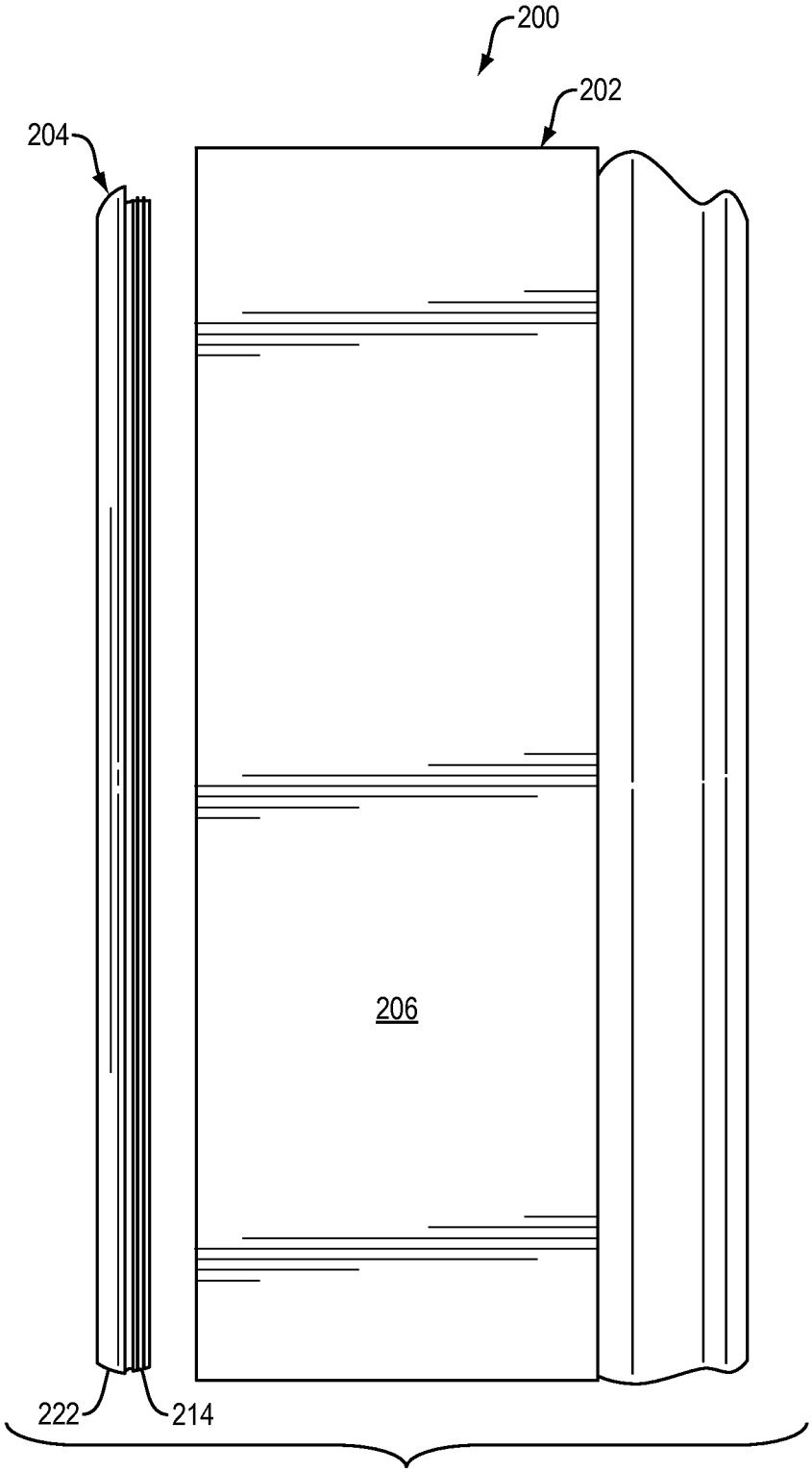
FIG. 3 is a front view of the baseboard and seal of the molding structure of FIG. 2.

FIGS. 2 and 3 are perspective and plan views, respectively, of a baseboard 202 and a seal 204 of a molding structure 200 according to an embodiment of the invention. The molding structure 200 includes similar features and can be installed in a similar way as molding structure 100 described above with reference to FIG. 1. In particular, the baseboard 202 of molding structure 200 has a front surface 206, a back surface 208 opposite the front surface, and a bottom surface 210 that extends between the front and back surfaces. The back surface 208 is configured to be mounted against a wall (e.g., wall 50, FIG. 1) and the bottom surface 210 is configured to be positioned spaced apart from a floor (e.g., floor 52, FIG. 1) adjoining the wall. The baseboard 202 includes a channel 212 along the bottom surface 210 of the baseboard. The seal 204 includes a flange 214 that is receivable in the channel 212 to mount the seal to the baseboard 202. The channel and the flange can have similar, but complementary shapes that are suitable to secure the flange to the baseboard, such as the T-shaped channel and flange described with reference to FIG. 1. In this particular example, the channel 212 is a rectangular channel and flange 214 is barb-shaped, i.e., has ribs extending outwardly from sides of the flange. As shown, baseboard 202 includes an ornamental surface 211, similar to ornamental surface 111 of baseboard 102 (FIG. 1).

Figure 4:
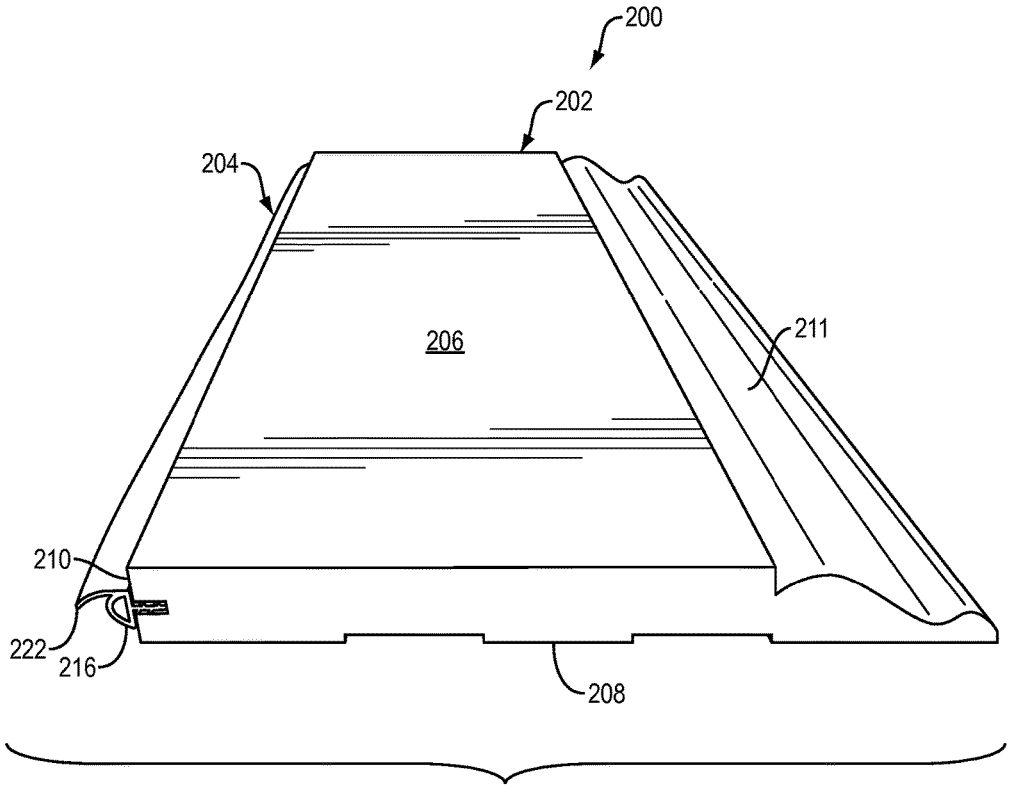
FIGS. 4, 5 and 6 are perspective, front and rear views, respectively, of the molding structure of FIG. 2 showing the seal mounted to the baseboard.

As shown in FIG. 2, the seal 204 is a bulb seal and includes a flexible wall 216, defining a cavity 218, and a flat portion 220. The flat portion 220 is in contact with the bottom surface 210 of the baseboard 202 when the bulb seal is mounted to the bottom surface of the baseboard, as shown in FIG. 4. The bulb seal 204 further includes a projection 222 extending from the flexible wall 216 and is configured to contact the floor when the molding structure is installed. In the particular example shown, the projection 222 is curved so that the surface of the projection that is in contact with the floor is closer to the wall than the remainder of the projection. Typically, the projection 222 is a flexible projection and can be integrally formed with flexible wall 216. The flange 214 can also be integrally formed with the flexible wall 216. For example, the bulb seal 204 can be a unitary piece of extruded silicone or polyvinyl chloride (PVC).

Figure 5:
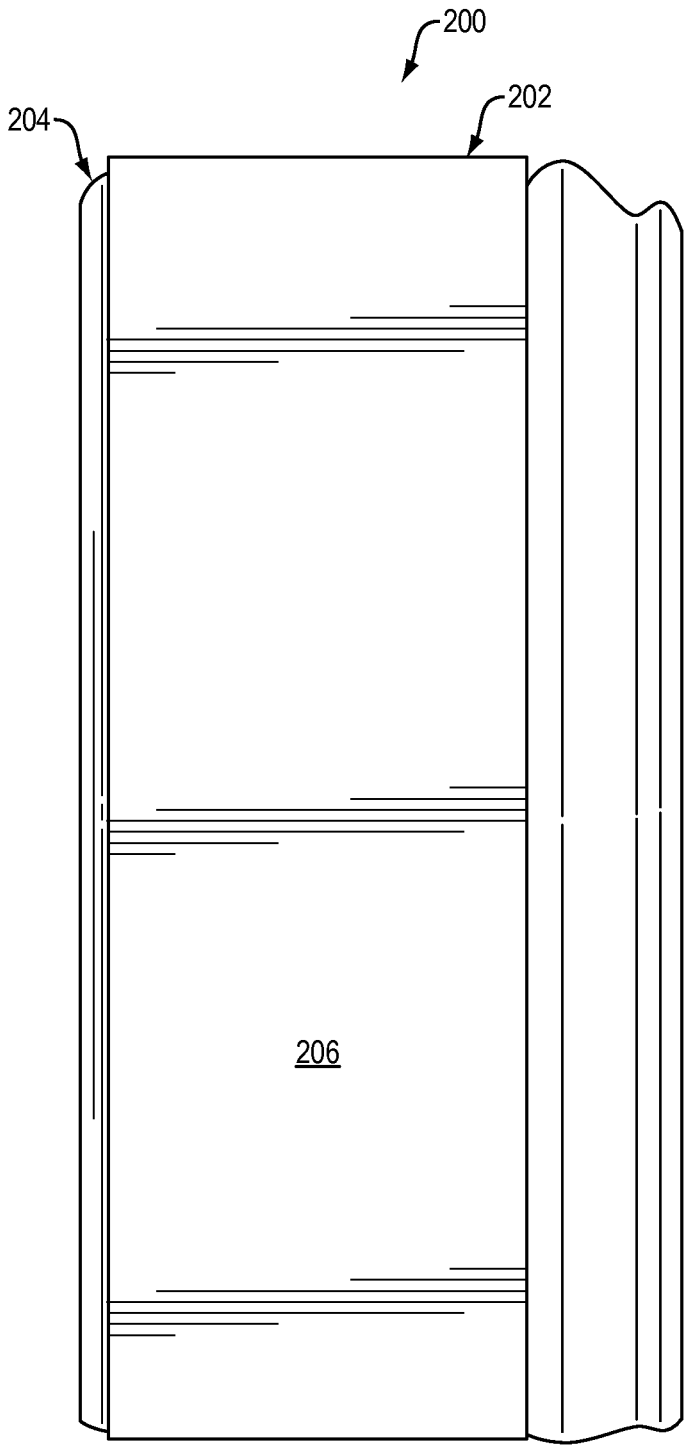
Figure 6:
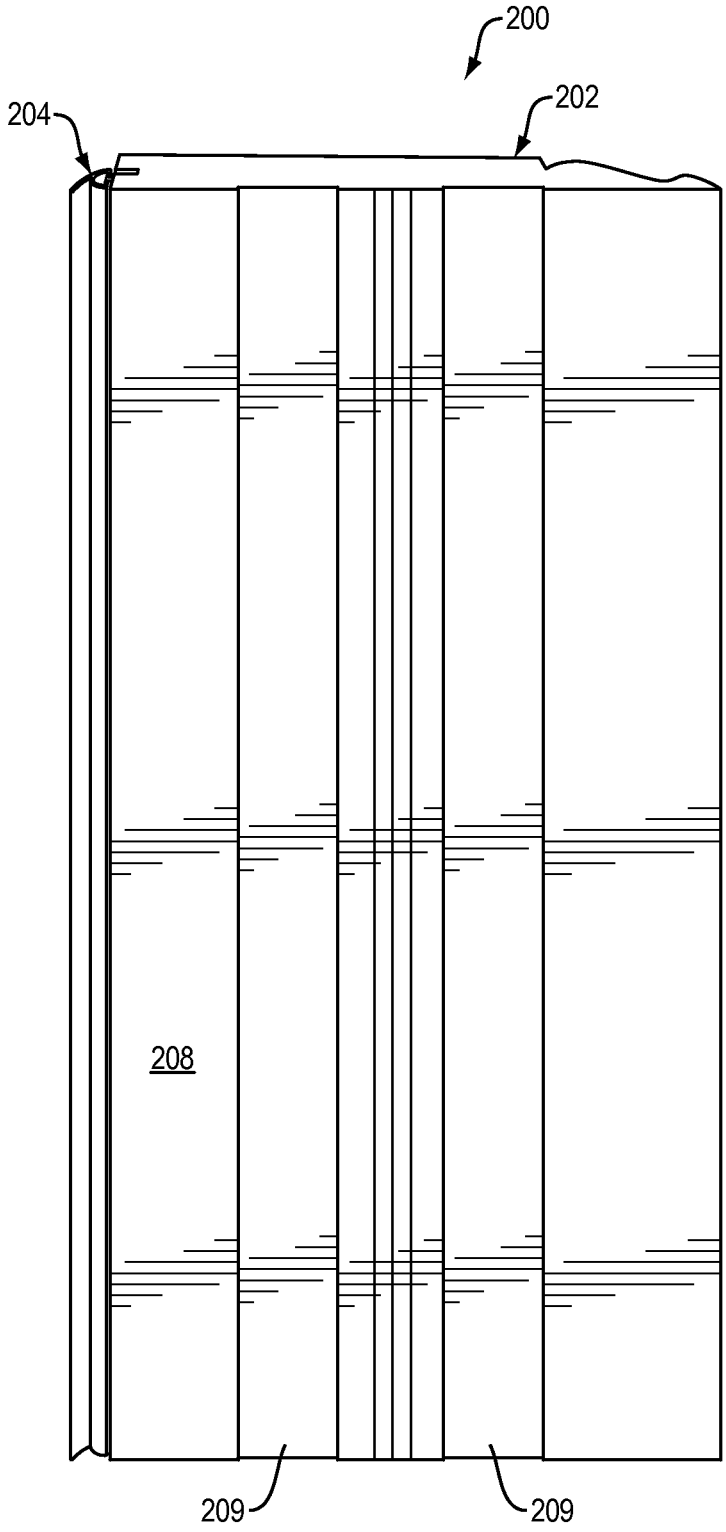

FIGS. 4, 5 and 6 are perspective, front and rear views, respectively, of the molding structure 200 of FIG. 2 showing the seal 204 mounted to the bottom surface 210 of baseboard 202. The seal 204 is configured so that the seal is compressed between the baseboard 202 and a floor, the baseboard being separated from the floor and the seal preventing flow of air between the baseboard and the floor, when the molding structure 200 is installed at a wall.

Figure 7:
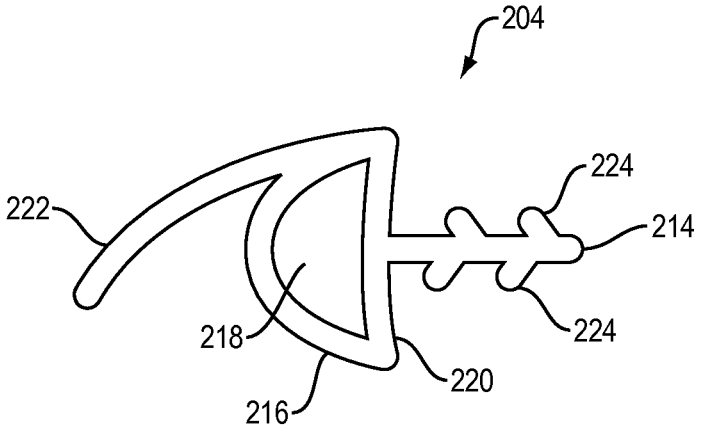
FIG. 7 is a detail view of a bulb seal suitable for use in an embodiment of the invention.

FIG. 7 is a detail view of a bulb seal 204 suitable for use in an embodiment of the invention. The flange 214 of the seal 204 includes a plurality of ribs 224 extending outwardly from the flange to provide a friction fit that secures the flange in the channel 212 (FIG. 4) of the baseboard. As shown, there is an acute angle between each rib 224 and a side of the flange 214. For example, the acute angle can be in the range of about 35 degrees to about 55 degrees. In the example shown, the acute angle is about 45 degrees. At any angle, the ribs 224 are preferably angled toward the flat portion 220 of the bulb seal 204.

The baseboard can be mounted to the wall using any suitable mounting techniques know in the art. For example, the baseboard can be mounted using one or more nails. The nails can be driven through the baseboard and into the wall. Advantageously, the nails can be driven into studs, such as wooden studs commonly found in residential building structures. Alternatively or in addition, an adhesive, e.g., caulking, can be used to secure the baseboard to the wall. In this case, the adhesive can be applied between any portion of the back surface of the baseboard and the wall. As illustrated in FIGS. 1, 2 and 6, the back surface 108, 208 of baseboard 102, 202 can include one or more grooves 109, 209 to receive and hold an adhesive, e.g., caulking. Placing the adhesive in grooves 109, 209 allows the remainder of the surface 108, 208 to be mounted flush against the wall.

The teachings of all patents, published applications and references cited herein, if any, are incorporated by reference in their entirety.

While this invention has been particularly shown and described with references to example embodiments thereof, it will be understood by those skilled in the art that various changes in form and details may be made therein without departing from the scope of the invention encompassed by the appended claims. For example, while the invention has been described with reference to molding structures that include a baseboard and that are mounted to a wall and an adjoining floor, the molding structure can be mounted to other building structures or at other locations. For example, the molding structure may be mounted at a wall and an adjoining ceiling, in which case the baseboard is replaced by or modified to be a crown molding. The seal is then mounted to a top surface of the crown molding and configured to be compressed between the crown molding and the ceiling.

What is claimed is:

1. A molding structure comprising:

a) a baseboard having a front surface, a back surface opposite the front surface, and a bottom surface extending between the front and back surfaces, the back surface proximate to the bottom surface configured to be mounted flush against a wall, the bottom surface configured to be positioned spaced apart from a floor adjoining the wall, the baseboard configured to be mounted to the wall; and b) a resilient seal mounted on the bottom surface of the baseboard and configured so that, once the molding structure is installed at a wall, the baseboard is spaced apart from the floor and the seal is in direct contact with the floor and compressed between the baseboard and the floor, the baseboard including a channel along the bottom surface of the baseboard, the seal including a flange receivable in the channel to mount the seal to the baseboard.

2. The molding structure of claim 1, wherein the channel and the flange are shaped so that the flange can be inserted into the channel to mount the seal to the baseboard.

3. The molding structure of claim 2, wherein the channel and the flange are T-shaped.

4. The molding structure of claim 2, wherein the channel and the flange are J-shaped.

5. The molding structure of claim 2, where the flange includes a plurality of ribs extending outwardly from the flange to provide a friction fit that secures the flange in the channel.

6. The molding structure of claim 5, wherein there is an acute angle between each rib and a side of the flange.

7. The molding structure of claim 6, wherein the acute angle is in the range of about 35 degrees to about 55 degrees.

8. The molding structure of claim 1, wherein the seal prevents the flow of air between the baseboard and the floor when the molding structure is installed at a wall.

9. The molding structure of claim 1, wherein the seal is a bulb seal.

10. The molding structure of claim 9, wherein the bulb seal includes a flexible wall, defining a cavity, and a flat portion in contact with the bottom surface of the baseboard when the bulb seal is mounted to the bottom surface of the baseboard.

11. The molding structure of claim 10, wherein the bulb seal further includes a flexible projection extending from the flexible wall and the projection being capable of contacting the floor when the molding structure is installed.

12. The molding structure of claim 11, wherein the projection is curved so that the surface of the projection that is in contact with the floor is closer to the wall than the remainder of the projection.

13. The molding structure of claim 1, wherein the seal is a unitary piece of extruded silicone or polyvinyl chloride (PVC).

14. The molding structure of claim 1, wherein the bottom surface is the lowermost surface of the baseboard.

15. The molding structure of claim 1, wherein the height of the baseboard is substantially greater than the width of the baseboard.

16. The molding structure of claim 1, wherein the back surface is substantially planar.

17. The molding structure of claim 1, wherein the back surface and the bottom surface form a corner and are substantially perpendicular to each other at the corner.

18. A method of installing a molding structure including a baseboard and a resilient seal, the method comprising:

a) placing the molding structure against a wall, the baseboard having a front surface, a back surface opposite the front surface, and a bottom surface extending between the front and back surfaces, the back surface configured to be mounted flush against the wall, the bottom surface configured to be positioned spaced apart from a floor adjoining the wall, the seal mounted on the bottom surface of the baseboard and configured so that, once the molding structure is installed at the wall, the baseboard is spaced apart from the floor and the seal is compressed between the baseboard and the floor, the baseboard including a channel along the bottom surface of the baseboard, the seal including a flange receivable by way of a friction fit in the channel to mount the seal to the baseboard;

b) applying pressure to the baseboard to move it toward the floor and compress the seal; and c) with the seal compressed, mounting the baseboard to the wall so that the back surface proximate to the bottom surface is mounted flush against the wall.

19. The method of claim 18, wherein the seal is a bulb seal and the seal, once the molding structure is installed at the wall, is in direct contact with the floor.

20. The method of claim 18, wherein the bottom surface is the lowermost surface of the baseboard.

21. A molding structure comprising:

a) a board having a front surface and a back surface opposite the front surface, the back surface configured to be mounted against a wall, the board further having a channel surface extending between the front and back surfaces and configured to be positioned spaced apart from a floor or ceiling adjoining the wall, the board including a channel along the channel surface; and b) a resilient seal mounted on the channel surface, the seal configured so that, once the molding structure is installed at the wall, the board is spaced apart from the floor or ceiling and the seal is compressed between the board and the floor or ceiling, and the seal comprising a flexible wall defining a cavity and a flange receivable by way of a friction fit in the channel to mount the seal to the board, at least a portion of the flexible wall comprising a substantially flat surface in contact with the channel surface when the flange is received by the channel, wherein the seal further includes a flexible projection extending from a proximal attachment to the flexible wall to a distal end of the projection, the projection being curved from the proximal attachment to the distal end.

22. The molding structure of claim 21, wherein the board is a baseboard and the seal is mounted on a bottom surface of the baseboard, the seal being compressed between the baseboard and the floor when the molding structure is installed at the wall.

23. The molding structure of claim 21, wherein the board is a crown molding and the seal is mounted on a top surface of the crown molding, the seal being compressed between the crown molding and the ceiling when the molding structure is installed at the wall.

* * * * *